US007294810B1

(12) United States Patent
Haseba et al.

(10) Patent No.: US 7,294,810 B1
(45) Date of Patent: Nov. 13, 2007

(54) HEATER, FIXING DEVICE AND IMAGE FORMING APPARATUS

(75) Inventors: Shigehiko Haseba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/634,164

(22) Filed: Dec. 6, 2006

(30) Foreign Application Priority Data

Apr. 6, 2006 (JP) ..... 2006-104999

(51) Int. Cl.
*H05B 11/00* (2006.01)
*G03G 15/08* (2006.01)

(52) U.S. Cl. ..... 219/216; 219/469; 219/470; 219/471; 118/60; 430/350; 430/353; 399/285; 399/286; 399/279; 399/328

(58) Field of Classification Search ..... 219/216, 219/469–71; 118/60; 430/350, 353; 347/154; 399/285–6, 279, 328, 333
See application file for complete search history.

(56) References Cited

U.S. PATENT DOCUMENTS 5,822,669 A 10/1998 Okabayashi et al.

FOREIGN PATENT DOCUMENTS

| | | |
|---|---|---|
| JP | A-11-133776 | 5/1999 |
| JP | A-2000-242108 | 9/2000 |
| JP | B2-3324351 | 7/2002 |
| JP | A-2002-260540 | 9/2002 |
| JP | A-2004-319418 | 11/2004 |

*Primary Examiner*—Shawntina Fuqua
(74) *Attorney, Agent, or Firm*—Morgan, Lewis & Bockius LLP

(57) ABSTRACT

A heater includes: a hollow tube sealed hermetically and reduced in pressure, the interior of the hollow tube being divided by at least one partition wall into a plurality of regions arranged side by side in a longitudinal direction of the tube; an electron source provided in each of the divided regions, the electron source being supported inside the hollow tube in an electrically insulated state from the hollow tube; a power supply that applies a voltage between the hollow tube and the electron source with the electron source as a negative polarity side; and the electron source emitting electrons toward an inner periphery surface of the hollow tube to heat the hollow tube.

10 Claims, 6 Drawing Sheets

HEATER, FIXING DEVICE AND IMAGE FORMING APPARATUS

CROSS-REFERENCE TO RELATED APPLICATIONS

This application is based on and claims priority under 35 USC 119 from Japanese Patent Application No. 2006-104999 filed Apr. 6, 2006.

BACKGROUND

1. Technical Field

The present invention relates to a heater wherein voltage is applied between opposed electrodes in a pressure-reduced state and an anodic electrode (anode) is heated by electrons emitted from a cathodic electrode (cathode) as an electron source, a fixing device for fixing a toner image with use of the heater, and an image forming apparatus.

2. Related Art

Generally, as a toner image fixing process in an image forming apparatus using a powdered toner, there is widely adopted a process wherein a toner image is transferred electrostatically onto a recording medium, then the recording medium is sandwiched in between a heating member and a pressurizing member to heat the toner image and pressure-bond the toner image to the recording medium.

In such a fixing device, a halogen lamp is in wide use as a heating source for heating the toner image. For example, a fixing roller having a halogen lamp in the interior of a cylindrical core and a pressing roller to be pressed against the fixing roller are provided and a nip portion is formed wherein rotating fixing roller and pressing roller are pressed against each other. A recording medium which carries an unfixed toner image thereon is fed to the nip portion and is conveyed. The fixing roller is heated by radiant heat radiated from the halogen lamp disposed in the interior, whereby the toner image on the recording medium passing through the nip portion is heated and pressurized.

Recently, as a measure against environmental issues it has also been required to suppress the consumption of energy. More particularly, in order to make the aforesaid warming-up time as short as possible and minimize the power consumption in stand-by condition, it is required that a portion of a fixing member for heating a toner image be heated locally efficiently.

In this connection, a fixing device which adopts an electromagnetic induction heating method instead of using a halogen lamp as a heating source is proposed.

SUMMARY

According to an aspect of the invention, there is provided a heater including: a hollow tube sealed hermetically and reduced in pressure, the interior of the hollow tube being divided by at least one partition wall into a plurality of regions arranged side by side in a longitudinal direction of the tube; an electron source provided in each of the divided regions, the electron source being supported inside the hollow tube in an electrically insulated state from the hollow tube; a power supply that applies a voltage between the hollow tube and the electron source with the electron source as a negative polarity side; and the electron source emitting electrons toward an inner periphery surface of the hollow tube to heat the hollow tube.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described hereunder with reference to the drawings.

Figure 6:
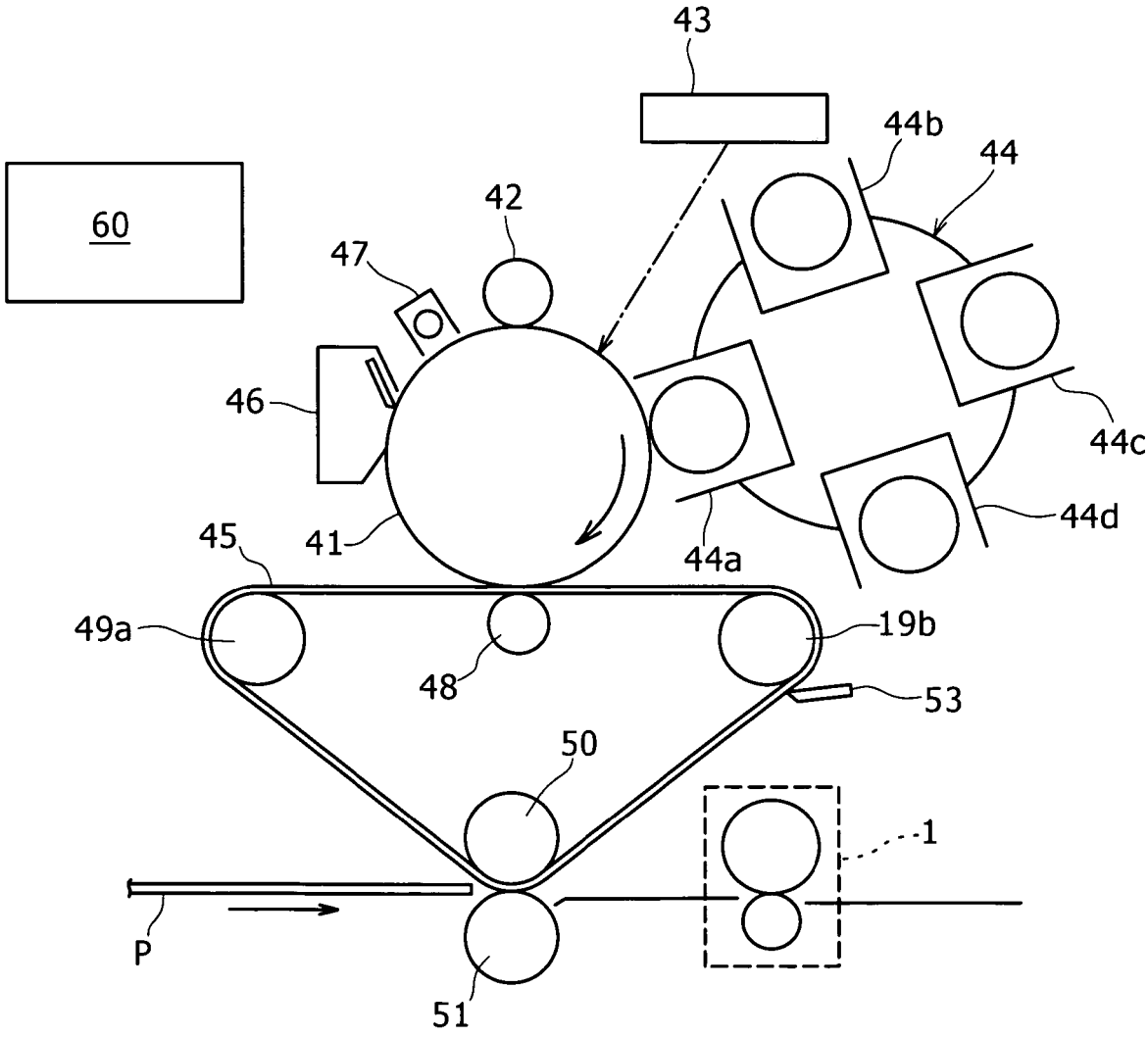
FIG. 6 is a schematic construction diagram showing an image forming apparatus using a fixing device according to an exemplary embodiment of the present invention.

FIG. 6 is a schematic construction diagram showing an image forming apparatus using a fixing device according to an exemplary embodiment of the present invention.

The image forming apparatus shown in FIG. 6 is provided with a cylindrical photosensitive drum 41 on the surface of which is formed a latent image based on an electrostatic potential difference upon exposure to image light after uniform charging. The image forming apparatus is further provided around the photosensitive drum 41 with a charging device 42 for charging the surface of the photosensitive drum 41 uniformly, an exposure device 43 that radiates image light to the photosensitive drum 41 to form a latent image on the drum surface, a developing unit 44 that causes toners to be transferred selectively onto the latent image on the photosensitive drum to form a toner image, an endless belt-like intermediate transfer member 45 opposed to the photosensitive drum 41 and whose peripheral surface is supported so as to be movable circumferentially, a cleaning device 46 for removing toner remaining on the photosensitive drum after transfer of the toner image, and a destaticizer 47 for destaticizing the surface of the photosensitive drum 41.

Inside the intermediate transfer member 45 are disposed a transfer charger 48 for a first transfer of the toner image formed on the photosensitive drum onto the intermediate transfer member 45, two support rollers 49*a* and 49*b*, and a transfer opposition roller 50 for performing a second transfer. With these components, the intermediate transfer member 45 is stretched bridgewise so as to be movable circumferentially. A transfer roller 51 for transfer of the toner image on the intermediate transfer member to recording paper is disposed at a position opposed to the transfer opposition roller 50 through the intermediate transfer member 45. Recording paper P is fed from a paper tray (not shown) to a pressure contact portion between the transfer opposition roller 50 and the transfer roller 51. Downstream of the pressure contact portion are disposed a fixing device 1 for heat-melting the toner image on the recording paper and bringing it into pressure contact with the recording paper and a cleaning device 53 for removing toner remaining on the intermediate transfer member, the cleaning device 53 being disposed at a position along the intermediate transfer member 45. Further provided is a controller 60 for controlling various portions of the image forming apparatus.

Figure 1:
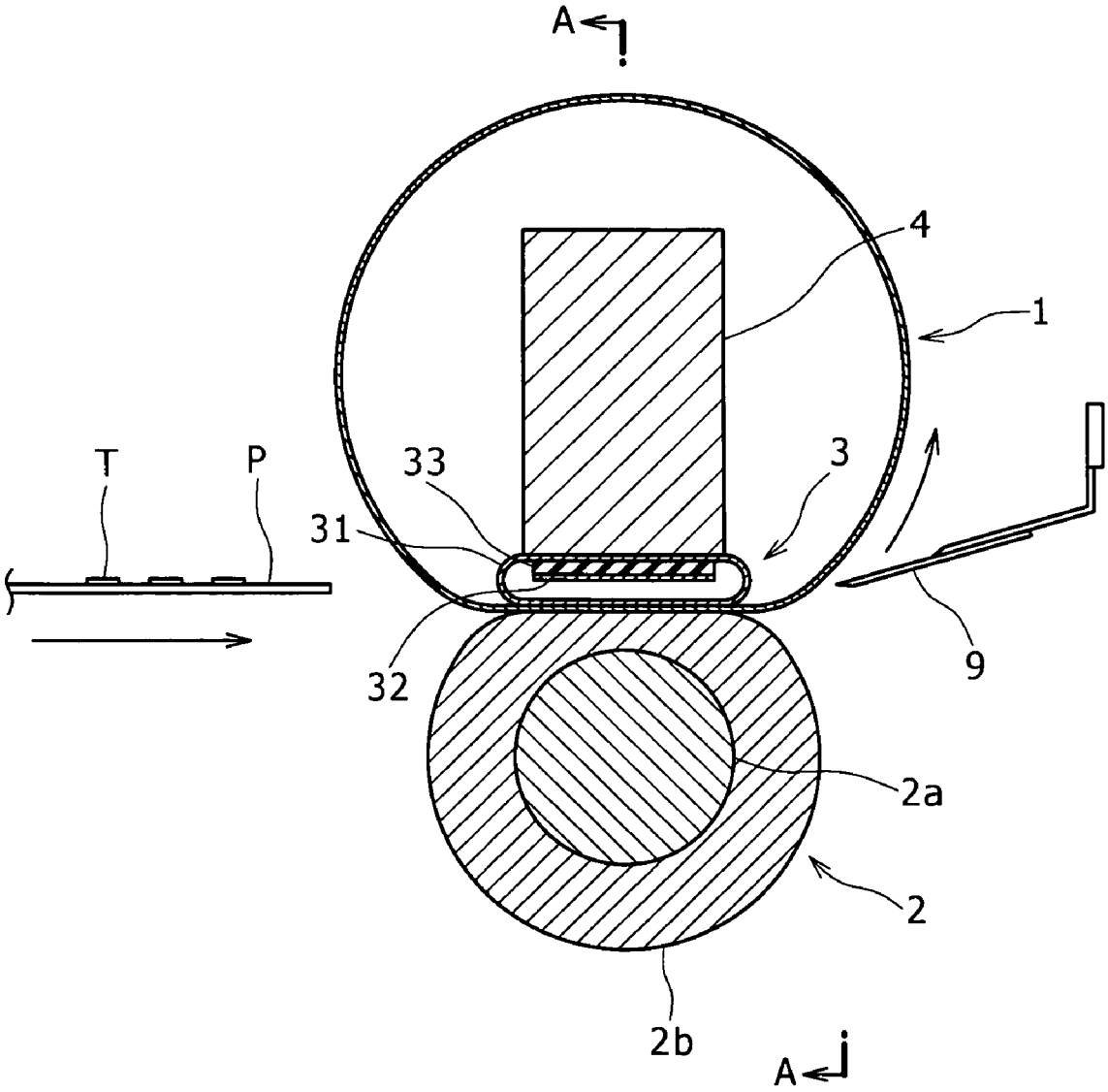
FIG. 1 is a schematic sectional view of a fixing device exemplarily embodying the present invention.
Figure 2:
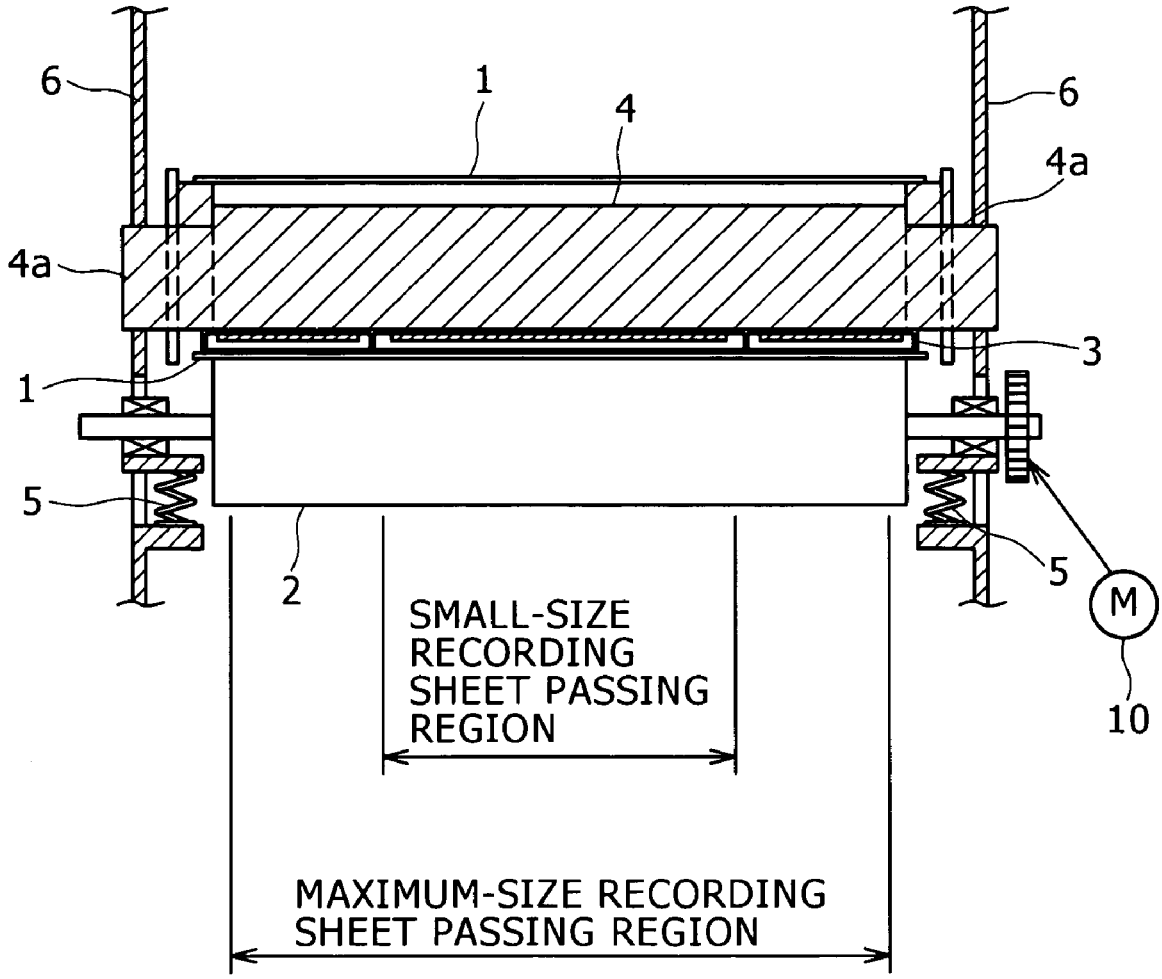
FIG. 2 is a sectional view taken on line A-A of the fixing device shown in FIG. 1.

FIG. 1 is a schematic sectional view of a fixing device according to an exemplary embodiment of the present invention and FIG. 2 is a sectional view taken on line A-A in FIG. 1.

The fixing device includes a fixing belt 1 having an endless peripheral surface, a pressing roller 2 adapted to be pressed against the outer periphery surface of the fixing belt 1, a heater 3 for heating the fixing belt 1, the heater 3 being abutted against the inner periphery surface of the fixing belt 1 at a position where the pressing roller 2 is pressed, and a pressing resistance member 4 supported fixedly by the inside of the endless fixing belt, the pressing resistance member 4 supporting the heater 3 at a predetermined position and resisting to the pressing force of the pressing roller 2. A recording sheet P which carries a toner image T is fed between the fixing belt 1 and the pressing roller 2 to heat and press the toner image T and fix it onto the recording sheet. A peeling member 9 is disposed downstream of the nip portion where the fixing belt 1 and the pressing roller 2 are brought into pressure contact with each other to peel and discharge the recording sheet from the fixing belt 1.

The fixing belt 1 is composed of a base layer formed by a thin film of stainless steel (SUS) and a surface release layer laminated onto the base layer.

As the base layer there may be used, for example, a thin layer of SUS having a thickness of 40 to 80 μm. In this example, there is used a thin film of SUS having a thickness of 50 μm.

The surface release layer is a layer which comes into direct contact with an unfixed toner image transferred onto the recording sheet. Therefore, polyimide resin or fluorine resin superior in releasability and durability may be used as the material of the surface release layer. In this example there is used a PFA layer having a thickness of 30 μm, provided it suffices for the layer to have a thickness of 1 to 30 μm.

The inner periphery surface of the base layer may be coated with fluorine resin in order to diminish the sliding resistance for the heater 3 abutted against the inner periphery surface of the base layer. A release agent such as, for example, silicone oil may be applied as lubricant to the inner surface of the fixing belt 1.

On the other hand, between the base layer and the surface release layer, there may be provided an elastic layer superior in heat resistance and heat conductivity such as, for example, silicone rubber, fluorine-containing rubber, or fluorosilocone rubber.

The pressing roller 2 is supported at a position opposed to the fixing belt 1 and both end portions thereof are urged toward the fixing belt 1 by means of springs 5. The pressing roller 2 includes a metallic cylindrical member 2*a* as a core member, an elastic member 2*b* having heat resistance such as silicone rubber or fluorine-containing rubber and formed on the surface of the cylindrical member 2*a*, and a surface release layer (not shown) as an outermost surface layer. The pressing roller 2 is rotated by a motor 10 and the fixing belt 1 is driven by friction induced in the portion where the fixing belt 1 is brought into pressure contact with the pressing roller 2. In this example, the pressing roller 2 is urged toward the heater 3 through the fixing belt 1 at a total load of 294 N (30 kgf).

Figure 3:
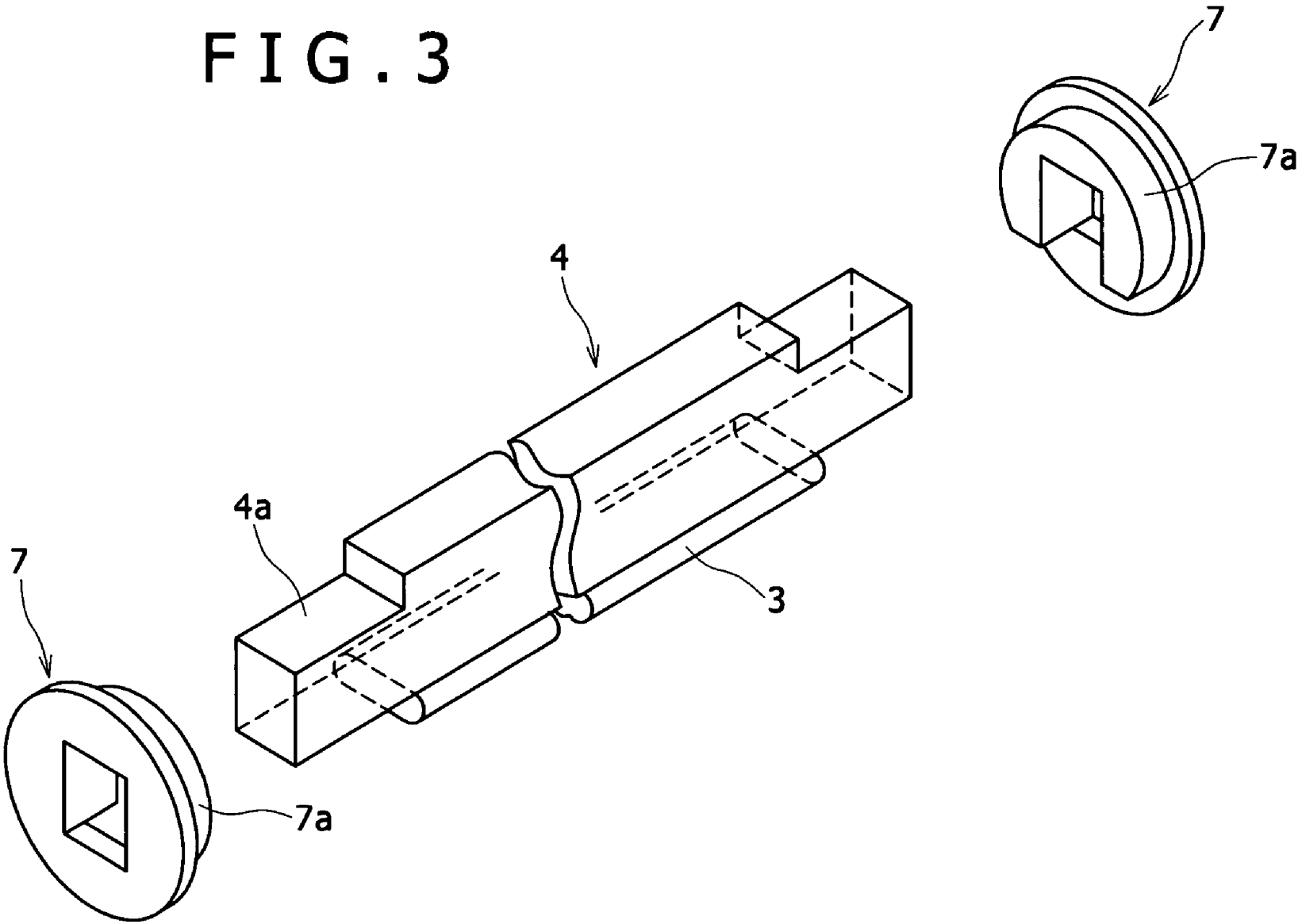
FIG. 3 is an exploded perspective view showing a pressing resistance member, a heater and a fixing belt guide member used in the fixing device shown in FIG. 1.

As shown in FIG. 3, the pressing resistance member 4 is a rod-like member having an axis in the width direction of the fixing belt 1. The pressing resistance member 4 has a shape such that both end portions 4*a* thereof project from side edges of the fixing belt 1. Both end portions 4*a* are supported fixedly by frames 6 in the fixing device and resist the pressing force acting thereon from the pressing roller 2 through the fixing belt 1 and the heater 3.

Guide members 7 for the fixing belt are fixed at positions near both ends of the pressing resistance member 4 and corresponding to side edges of the fixing belt 1. Sliding portions 7*a* of the guide members 7 are brought into abutment against the inner periphery surface of the fixing belt 1 in the vicinity of the side edges of the fixing belt to restrain the shape of the fixing belt 1 when moved in the circumferential direction, thereby permitting a smooth drive.

It is necessary for the material of the pressing resistance member 4 to have a rigidity such that the amount of deflection upon receipt of a pressing force from the pressing roller 2 is below an allowable level, which may be below 1 mm. A heat-resisting resin such as, for example, glass fiber-filled PPS (polyphenylene sulfide), phenol, polyimide, or a liquid crystalline polymer may be used.

Figure 4A:
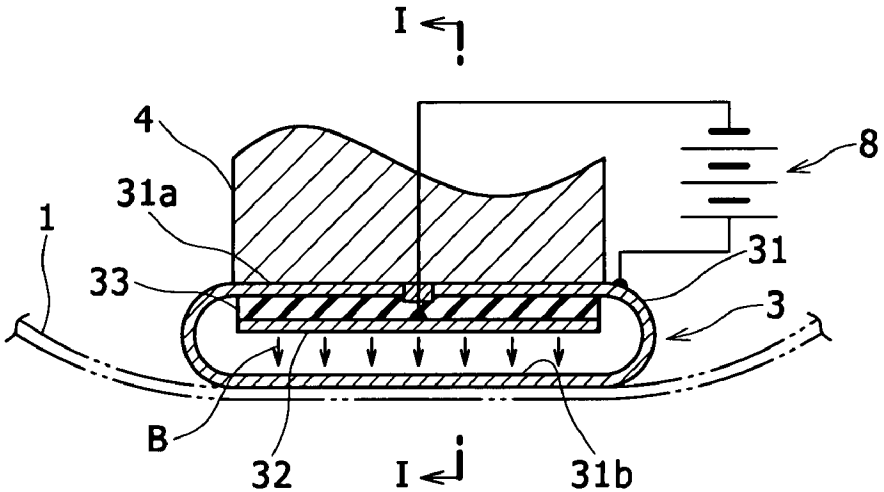
FIGS. 4A and 4B are sectional views of a heater exemplarily embodying the present invention and used in the fixing device of FIG. 1.

As shown in FIGS. 1 and 2, the heater 3, which is an exemplary embodiment of the present invention, is supported fixedly by the pressing resistance member 4 and is abutted against the inner periphery surface of the fixing belt 1 to heat the fixing belt 1 directly. The heater 3 includes a hollow tube 31 formed of metal such as aluminum alloy or SUS. As shown in FIG. 4, the tube 31 has a flat sectional shape and an electron source 32 is supported fixedly in the interior of the tube 31. The flat section of the hollow tube 31 provides portions 31*a* and 31*b* whose peripheral surfaces are close to each other. The portions 31*a* and 31*b* form substantially flat surfaces. The electron source 32 is supported by the inner periphery surface of one flat portion 31*a* through an insulating layer 33 and the outer periphery surface of this portion is fixed to the pressing resistance member 4. The outer periphery surface of the other flat portion 31*b* is put in abutment against the fixing belt 1 and the fixing belt 1 is heated by heat conduction from this portion.

Figure 5:
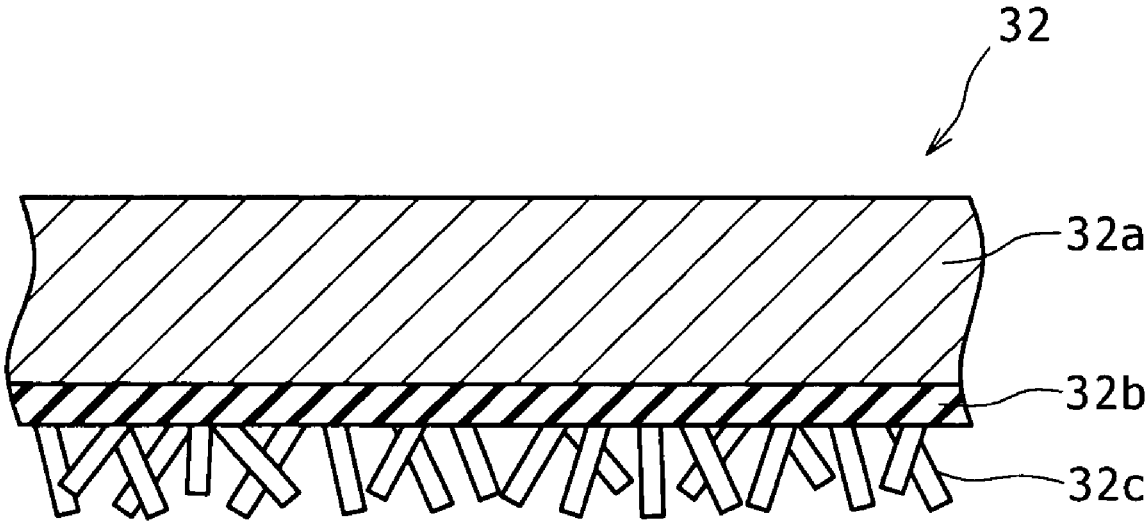
FIG. 5 is an enlarged sectional view of an electron source used in the heater of FIG. 4.

The electron source 32 is supported fixedly by one of the flat peripheral surface portions of the tube 31 through the insulating layer 33 and is opposed through a gap of about 1 mm to the inner periphery surface of the tube 31 on the side where the tube 31 is abutted against the fixing belt 1. As shown in FIG. 5, the electron source 32 includes a metallic electrode 32*a* and a coating layer 32*b* formed on the electrode 32*a*. The coating layer 32*b* is formed with very small projections 32*c* of a nano-scale formed of carbon nanotubes. To be exact, the carbon nanotubes are soot containing carbon nanotubes. Components of the soot include carbon nanotubes, amorphous carbon, small pieces of graphene, and nickel or yttrium as a catalyst metal for the formation of carbon nanotubes.

The coating layer 32*b* may be formed in the following manner.

Soot containing nanotubes described above is pulverized by means of a mixer and mixed with liquid ethanol to prepare a suspension. Then, the suspension is sprayed to the electrode 32*a* in the electron source 32. Thereafter, an adhesive tape is affixed to the thus-coated surface and is peeled off, whereby the very small projections 32*c* of nanotubes can be formed.

There also may be adopted another method for forming the very small projections 32*c* on the coating layer 32*b*.

The interior of the tube 31 is pressure-reduced and bias voltage making the electron source 32 negative in polarity is applied between the electron source 32 and the tube 31 from a power supply unit 8. For example, voltage at which the electron source 32 becomes relatively negative in polarity may be applied between the electron source 32 and the tube 31, or the tube 31 may be electrically connected to ground and potential of a negative polarity may be applied to the electron source 32.

By the application of such bias voltage the electrons emitted from the electron source 32 move to the positive polarity side within the pressure-reduced tube and jump to the opposite flat portion (heating surface) 31*b* of the tube 31. The energy of the electrons become heat energy on the heating surface 31*b* and is heated.

As to the above pressure-reduced state, it suffices for the state to be a removed state of remaining gas to such an extent as does not obstruct the flying of electrons. More particularly, it suffices for the state in question to be a pressure-reduced state to $10^{-3}$ Pa or lower.

In this embodiment the gap between the electron source 32 and the heating surface 31*b* of the tube is set at 1 mm, but the smaller the gap, the larger the amount of electrons which are field-emitted and the more rapidly is it possible to effect heating. Therefore, the heating speed can be controlled by adjusting the gap.

Moreover, the higher the negative bias voltage in the electron source 32 relative to the heating surface 31*b*, the larger the amount of electrons which are field-emitted and the higher the heating speed is. Therefore, also by adjusting the voltage to be applied between the electron source 32 and the tube 31 it is possible to control the heating speed and the heating temperature.

The electron source 32 can be heated also by supplying an electric current into an electrode, whereby thermions are emitted and the heating surface 31*b* of the tube 31 can be heated rapidly. The electron source may be of the type having an electron extraction electrode, i.e., grid, and emit electrons as a cold cathode.

Figure 4B:
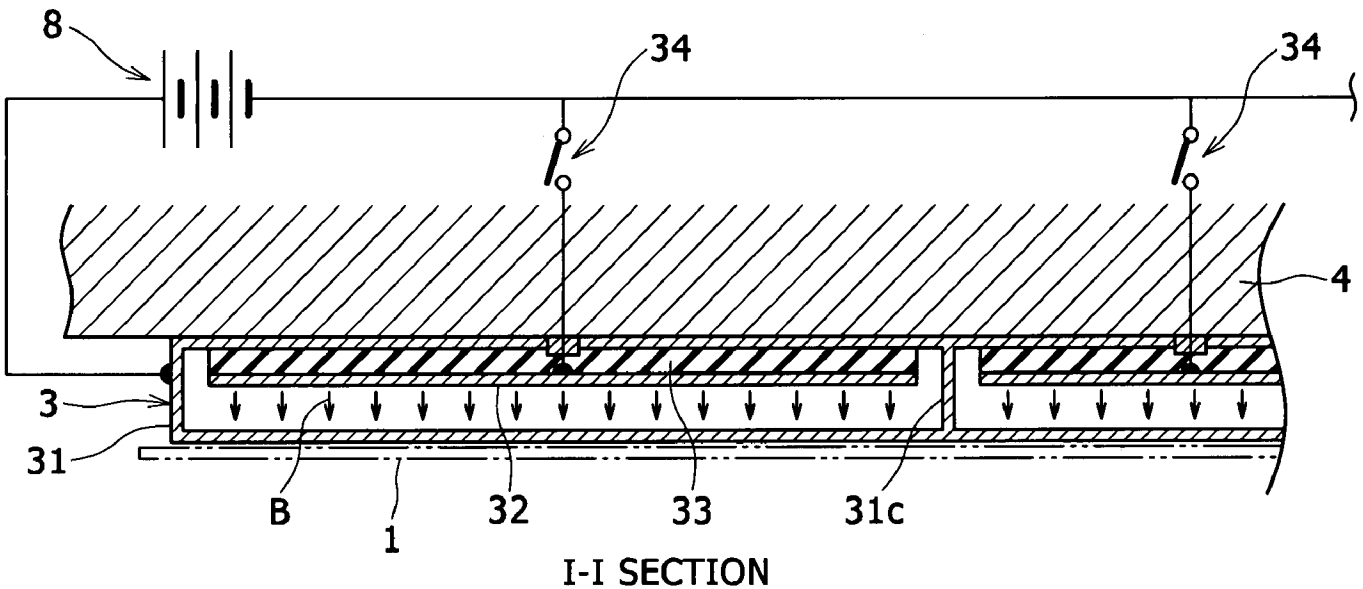

As shown in FIG. 4B, the interior of the tube 31 is divided into plural regions axially by means of a partition wall 31*c* disposed in the interior of the tube 31. The electron source 32 is mounted in each of the divided regions through the insulating layer 33. With switching elements 34, bias voltage can be applied independently to each electron source 32, that is, the generation of heat can be controlled independently for each divided region. According to this construction, even when heat is robbed of by a recording sheet P in the passing region of the recording sheet in accordance with the size of the recording sheet which is fed into the fixing device and there arises a temperature difference between the recording sheet passing region and the other region, i.e., non-passing region of the sheet, it is possible to keep the temperature of the paper passing region appropriate and prevent overheating of the non-passing region.

Next, a description will be given below about the operation of the fixing device.

In an image forming section, a toner image T is formed using four-color toners of yellow, magenta, cyan and black and in accordance with an image signal and is transferred onto the recording sheet P by means of a transfer unit (not shown). The toners are each made up of a binder of a thermoplastic resin and a colored pigment contained therein.

On the other hand, almost at the same time when the toner image forming operation is started, the motor 10 for driving the pressing roller 2 is turned ON and the pressing roller 2 is rotated. With the rotation of the pressing roller 2 the fixing belt 1 moves in the circumferential direction.

Further, voltage is applied between the electron source 32 and the tube 31 in the heating 3. Consequently, the electrons field-emitted from the electron source 32 move toward the opposite peripheral surface of the tube 31 as indicated by arrows B in FIG. 4 and the electrons-reached portion is heated rapidly.

The recording sheet P which carries the unfixed toner image T is superimposed on the fixing belt 1 so that the toner image T is abutted against the belt, and is fed to the nip portion where the pressing roller 2 is pressed against the recording sheet P. In the nip portion, the fixing belt 1 and the recording paper P are brought into strong pressure contact with each other at the position between the pressing roller 2 and the heater 3. As a result, heat is conducted from the heater 3 to the toner image T through the fixing belt 1 and the toner thereby softens and is brought into pressure contact onto the recording sheet.

The heater 3 has a flat sectional shape, so in the nip portion it is brought into pressure contact with the fixing belt 1 over a wide flat surface portion thereof and the toner image T is headed and pressurized in this range. Thus, the toner image is heated sufficiently and is fixed to a satisfactory extent. In the flat peripheral surface portion of the tube 31 the electron source 32 and the inner peripheral surface of the tube 31 are opposed to each other at a substantially equal spacing and this area is heated almost uniformly, so that the toner image heating temperature is controlled appropriately and fixing is performed to a satisfactory extent without unevenness in luster or offset. Besides, heating can be done limitedly to the circumferential area of the tube 31 which area comes into abutment against the fixing belt 1 and thus efficient heating can be effected.

Moreover, the internal space of the tube 31 is divided axially, and therefore, when using a recording sheet of a small size, the controller 60 in the image forming apparatus sets the time for heating only the recording sheet passing region and maintains this region at a temperature suitable for fixing, whereby it becomes possible to prevent overheating of the region where the recording sheet does not pass.

On the other hand, since the electron source 32 incorporated in the heater 3 is opposed in proximity over a wide range to the inner periphery surface of the tube 31, it is possible to emit a large amount of electrons even at a low voltage and heat the tube 31 rapidly over the wide range.

Further, the very small projections 32*c* are formed on the coating layer 32*b* of the electrode 32*a* in the electron source 32 and the tip size thereof is on the order of nanoscale. Therefore, a strong field concentration occurs at the tip portion of each of the very small projections 32*c* and electrons are emitted by the application of a low voltage, whereby it is possible to achieve a high-frequency heating.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heater comprising:

a hollow tube sealed hermetically and reduced in pressure, the interior of the hollow tube being divided by at least one partition wall into a plurality of regions arranged-side by side in a longitudinal direction of the tube;

an electron source provided in each of the divided regions, the electron source being supported inside the hollow tube in an electrically insulated state from the hollow tube;

a power supply that applies a voltage between the hollow tube and the electron source with the electron source as a negative polarity side; and the electron source emitting electrons toward an inner periphery surface of the hollow tube to heat the hollow tube.

2. The heater according to claim 1, wherein the electron sources are each mounted on a predetermined circumferential area of the inner peripheral surface of the hollow tube with an insulating layer provided therebetween.

3. The heater according to claim 2, wherein the hollow tube has a substantially flat sectional shape having two planar portions opposed in proximity to each other, and the electron sources are each mounted on an inner periphery surface of one of the planar portions of the hollow tube with the insulating layer provided therebetween.

4. The heater according to claim 1, wherein the electron sources each comprise an electrode, the electrode having a surface provided with a multitude of very small projections.

5. A heater comprising:

a hollow tube sealed hermetically and reduced in pressure, the interior of the hollow tube being divided by at least one partition wall into a plurality of regions arranged side by side in a longitudinal direction of the tube;

an electron source provided in each of the divided regions, the electron source being supported inside the hollow tube in an electrically insulated state from the hollow tube;

a power supply that applies a voltage between the hollow tube and the electron source with the electron source as a negative polarity side, the application of voltage between the electron source and the hollow tube by the power supply being controlled independently for each of the electron sources provided in the divided regions; and the electron source emitting electrons toward an inner periphery surface of the hollow tube to heat the hollow tube.

6. A fixing device comprising:

an endless fixing belt supported movably in a circumferential direction;

a heater that contacts an inner periphery surface of the fixing belt to heat the fixing belt;

a pressing member to be pressed against an outer periphery surface of the fixing belt; and the fixing belt and the pressing member passes through therebetween a recording sheet that carries a toner image to fix the toner image onto the recording sheet by heat and pressure, the heater comprising:

a hollow tube sealed hermetically and reduced in pressure, the interior of the hollow tube being divided by at least one partition wall into a plurality of regions arranged side by side in a longitudinal direction of the tube;

an electron source provided in each of the divided regions, the electron source being supported inside the hollow tube in an electrically insulated state from the hollow tube;

a power supply that applies a voltage between the hollow tube and the electron source with the electron source as a negative polarity side; and the electron source emitting electrons toward an inner periphery surface of the hollow tube to heat the hollow tube.

7. The fixing device according to claim 6, wherein the application of voltage between the electron source and the hollow tube by the power supply is controlled for each of the electron sources provided in the divided regions.

8. An image forming apparatus comprising:

an image forming unit that forms a toner image on a recording medium; and a fixing device that fixes the toner image onto the recording medium, the fixing device comprising:

an endless fixing belt supported movably in a circumferential direction;

a heater that contacts an inner periphery surface of the fixing belt to heat the fixing belt;

a pressing member to be pressed against an outer periphery surface of the fixing belt; and the fixing belt and the pressing member passes through therebetween a recording sheet that carries a toner image to fix the toner image onto the recording sheet by heat and pressure, the heater comprising:

a hollow tube sealed hermetically and reduced in pressure, the interior of the hollow tube being divided by at least one partition wall into a plurality of regions arranged side by side in a longitudinal direction of the tube;

an electron source provided in each of the divided regions, the electron source being supported inside the hollow tube in an electrically insulated state from the hollow tube;

a power supply that applies a voltage between the hollow tube and the electron source with the electron source as a negative polarity side; and the electron source emitting electrons toward an inner periphery surface of the hollow tube to heat the hollow tube.

9. The image forming apparatus according to claim 8, wherein the application of voltage between the electron source and the hollow tube is controlled independently for each of the electron sources provided in the divided regions.

10. The image forming apparatus according to claim 8, further comprising a controller, the controller determining a region to be heated out of the divided regions of the hollow tube in accordance with a size of the recording medium and making control so as to apply voltage between the electron source provided in the determined region and the hollow tube.

* * * * *